US005539416A

United States Patent [19]

Castaneda et al.

[11] Patent Number: 5,539,416

[45] Date of Patent: Jul. 23, 1996

[54] ANTENNA MOUNTING ASSEMBLY

[75] Inventors: Julio C. Castaneda, Coral Springs, Fla.; Stuart A. Heilsberg, Buffalo Grove, Ill.; Peter D. Iezzi, Coral Springs, Fla.

[73] Assignee: Motorola, Inc., Schaumburg, Ill.

[21] Appl. No.: 270,619

[22] Filed: Jul. 5, 1994

[51] Int. Cl.[6] ..... H01Q 1/24

[52] U.S. Cl. ..... 343/702; 343/906; 174/153 A

[58] Field of Search ..... 343/702, 878, 343/906; 174/153 A; 361/760, 773, 785; 439/78, 83, 84; H01Q 1/24

[56] References Cited

U.S. PATENT DOCUMENTS

| | | | |
|---|---|---|---|
| 3,349,405 | 10/1967 | Wright | 343/702 |
| 5,258,772 | 11/1993 | Inanaga e tal. | 343/702 |
| 5,313,365 | 5/1994 | Pennisi et al. | 361/760 |

*Primary Examiner*—Hoanganh Le
*Attorney, Agent, or Firm*—Frank M. Scutch, III

[57] ABSTRACT

An antenna assembly (300) includes an antenna nut (100) which is reflow soldered onto a printed circuit board (202). First and second radio housing members (302, 304) provide additional support to the antenna nut (100).

13 Claims, 3 Drawing Sheets

ANTENNA MOUNTING ASSEMBLY

TECHNICAL FIELD

This invention relates generally to antenna mounting assemblies and more specifically to an antenna mounting assembly for use in portable radios.

BACKGROUND

The antenna and antenna mounting assembly used on portable two-way radios are exposed to severe abuse and very high mechanical stresses. Users of two-way radios routinely use the antenna to pick-up the radio, such as when pulling the radio out of its carry case when it is being carried by the radio user.

A common method of making electrical connection between the radio electronics and the radio antenna requires electrically connecting an antenna nut or bushing, located on the radio housing to the radio electronics using a spring finger contact mounted on the radio printed circuit board which also makes contact to the antenna nut or bushing. In the second method, a coax cable is soldered between the radio printed circuit board and the antenna nut or bushing. The impedance of the connection from the radio printed circuit board to the antenna nut or busing is very critical to the electrical performance of the radio. Both the spring finger and coax connections used in the prior art antenna mounting approaches have drawbacks. The spring connection approach has the problem that the spring force and contact resistance can vary due to the tolerance stack-up associated between the antenna nut and the radio printed circuit board. The coax cable approach provides for improved electrical performance, but the labor time required for such an assembly increases the overall manufacturing cost of the radio.

Prior art antenna nut or bushings are commonly affixed to the radio housing in two ways. The first way is to insert-mold or ultrasonically swage the antenna nut or bushing into the radio housing which is typically manufactured using plastic. A common failure of insert molding or swaging the antenna nut is that the antenna nut is prone to break out of the plastic housing when subjected to high forces. Also, if the radio housing is highly stressed or deflected, the internal spring connecting the antenna nut to the radio electronics on the printed circuit board may become permanently damaged and loose electrical contact to the nut. The second method of affixing the antenna nut or bushing is to press fit the antenna nut or bushing into a metal casting. This method requires an additional insulating material between the antenna nut and the casting. Though stronger than insert molding or swaging, mechanical stress can also cause the press fit area to break. Press fitting the antenna nut can also cause high variance in the forces capable to be withstood between different radios. Some radios may exhibit stronger press fitted connections, while other radios may exhibit lower strength connections.

Thus, a need exists for an improved antenna mounting assembly and especially for an antenna mounting nut or bushing which can provide for a more reliable and stronger antenna connection.

DETAILED DESCRIPTION OF THE PREFERRED EMBODIMENT

Figure 1:
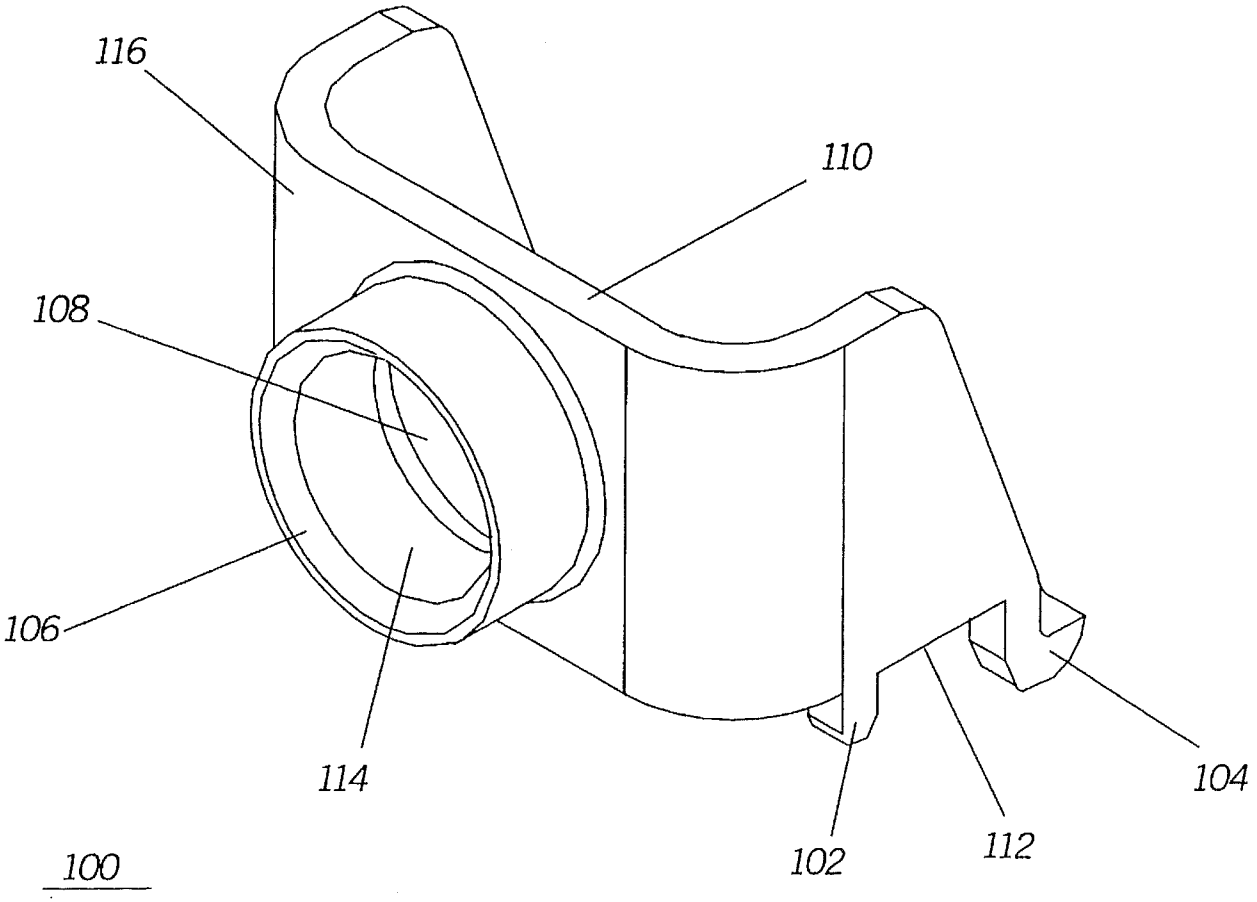
FIG. 1 is an isometric view of an antenna mounting nut in accordance with the present invention.

Referring now to the drawings and specifically to FIG. 1, there is shown an antenna nut or bushing 100 in accordance with the invention. Antenna nut 100 includes two curved end legs ("dog-legs") 104 located in the rear of the antenna nut 100 which anchor the antenna nut 100 onto a printed circuit board (shown in FIG. 2). Two front legs 102 locate the antenna nut from front-to-back on the printed circuit board. The antenna nut 100 includes an aperture 108 located on main wall member 116. Aperture 108 includes a front rim edge which includes a lead-in chamfer 106 for ease of assembly. Aperture 108 preferably has a threaded inner wall 114. In the preferred embodiment the thread is a ¼–32 UNFE thread. A radio antenna (not shown) is threaded to the antenna nut, as will be explained later.

Antenna nut 100 is preferably formed from Nickel-Silver or other conventionally used metals or metal alloys. Antenna nut 100 can be formed from an extruded piece of sheet metal. Antenna nut 100 further includes a pair of edges 112 located between each pair of front and rear leg members. The pair of edges 112 lie flush against the surface of the printed circuit board when front and rear legs 102 and 104 are inserted onto corresponding apertures located on the printed circuit board. A back inside wall 110 is provided on antenna nut 100.

Figure 2:
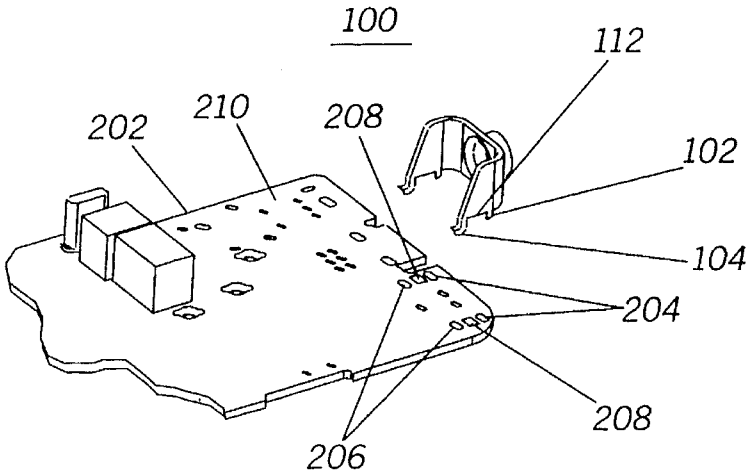
FIG. 2 is an exploded view of the antenna nut of FIG. 1 with a radio printed circuit board in accordance with the invention.

In FIG. 2, an exploded view of the antenna nut of FIG. 1 with a printed circuit board 202 is shown. The printed circuit board 202 includes first and second front locating holes or apertures 204 used for receiving the front legs 102 of antenna nut 100. First and second rear locating holes or apertures 206 are used for receiving the rear "dog-leg shaped" legs 104 of antenna nut 100. Apertures 206 are preferably unplated, while front locating apertures 204 are preferably plated through.

Once the antenna nut 100 is inserted in to the locating holes 204 and 206 it is reflow soldered to printed circuit board 202. The weight of the antenna nut 100 together with the rear dog-legs 104 maintain the antenna nut 102 flush to the first major surface 210 of printed circuit board 202. The printed circuit board 202 also includes first and second solder pads 208 located on the first major surface 210, one each located between front apertures 204 and rear apertures 206. The solder pads 208 are soldered to the printed circuit board edges 112 of antenna nut 100. This helps provide additional mechanical support to antenna nut 100.

Figure 3:
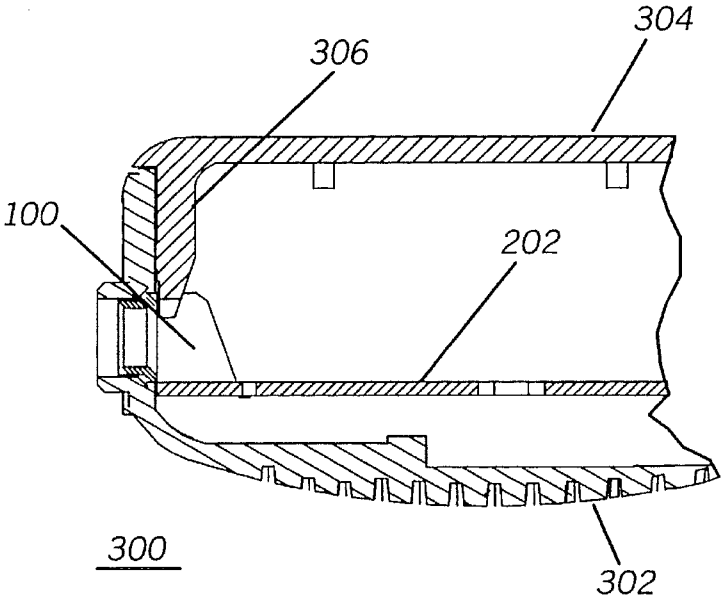
FIG. 3 is a partial cross-sectional view of a radio showing the antenna mounting assembly of the present invention.

Referring now to FIG. 3, a partial cross-sectional view of a radio 300 showing the antenna mounting assembly of the present invention. The radio 300 includes a front radio housing member 302 and rear radio housing member 304. Antenna nut 100 is supported by the front 302 and rear 304 radio housing members, thereby providing for a strong mechanical connection. The housing members provide for a tight tolerance around antenna nut 100. In the preferred embodiment, the mechanical tolerance around antenna nut 100 is approximately 0.19 millimeter (0.0075 inch) all around the front portion of antenna nut 100.

Rear housing member 304 backs-up against the back wall 110 of antenna nut 100. The antenna nut 100 is therefore supported when pressed inward towards the radio. Due to the tight clearances that are used to support antenna nut 100, the printed circuit board 202 is allowed to float within the radio housing and is located side-to-side and front-to-back by the antenna nut 100. Initial testing of the antenna mounting assembly of the present invention have shown a significant increase (i.e., approximately 2 to 3 times greater strength) in push, pull and torque strength as compared to prior antenna mounting assemblies.

Figure 4:
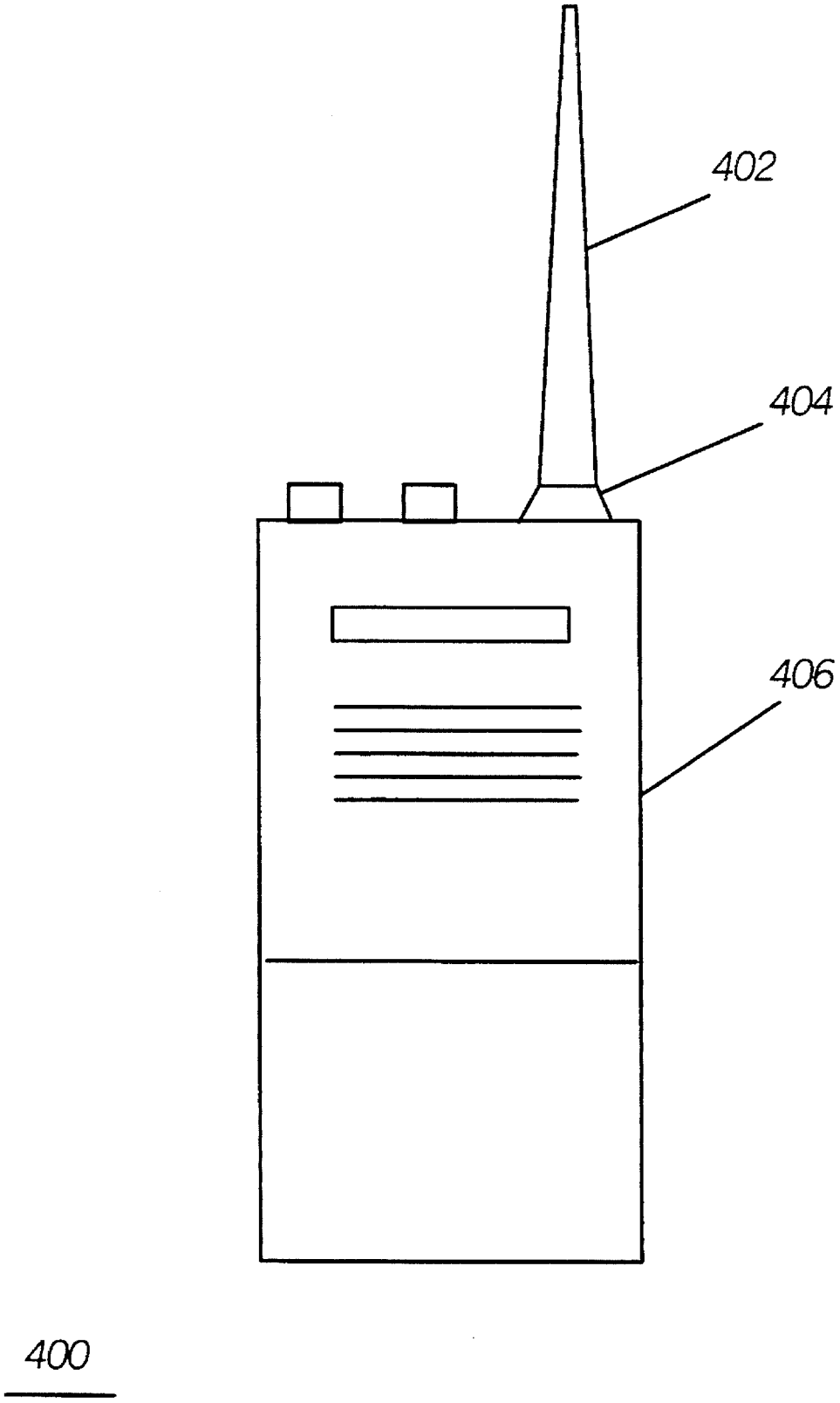
FIG. 4 illustrates a radio in accordance with the invention.

In FIG. 4, a radio 400 in accordance with the invention is shown. Radio 406 includes a bumped-up housing portion 404 which encloses the antenna mounting assembly described in FIG. 3. An antenna 402 is threaded directly to the antenna nut located within the radio housing. Since the antenna nut 100 is open at the bottom, the antenna skirt provides a rain and moisture seal against the housing when torqued.

In summary, the present invention reduces the cost as compared to past antenna assemblies for three reasons. First, it eliminates the need to insert-mold, swage or press-fit the antenna nut to the housing or to a casting. Second, the present antenna nut can be threaded directly in the progressive die using an automated tap which eliminates the cost of any secondary threading operations. Finally, since the nut is infrared (IR) reflowed to the board, there are no labor intensive hand-solder operations as compared to using coax cables or spring finger contacts. These three reasons combine to keep the cost of providing an antenna nut low.

What is claimed is:

1. An antenna mounting assembly, comprising:

a printed circuit board having a pair of front locating apertures and a pair of rear locating apertures, the printed circuit board further including a pair of solder pads located between the pair of front locating apertures and the pair of rear locating apertures; and an antenna nut, the antenna nut including a flanged section having a threaded aperture for attaching to an antenna and a pair of rear legs and a pair of front legs, the pair of rear legs are inserted into the pair of rear locating apertures and the pair of front legs are inserted in to the pair of front locating apertures, the antenna nut further including first and second edge sides which are soldered to the first and second solder pads respectively.

2. An antenna mounting assembly as defined in claim 1, wherein the pair of rear legs on the antenna nut are curved.

3. An antenna mounting assembly as defined in claim 2, wherein the pair of rear locating apertures are not plated through apertures.

4. An antenna mounting assembly as defined in claim 1, wherein the pair of front locating apertures are plated apertures and the pair of front legs on the antenna nut are soldered to pair of front locating apertures.

5. An antenna mounting assembly as defined in claim 1, wherein the antenna nut is extruded from a piece of sheet metal.

6. A radio, comprising:

a radio housing; and an antenna mounting assembly attached to the radio housing, the antenna mounting assembly, including:

a printed circuit board located within the radio housing;

an antenna nut soldered to the printed circuit board, the antenna nut including a flanged section having a threaded aperture for attaching to an antenna and first and second front and rear leg members, and first and second edges located between each of the first and second front and rear leg members, and the first and second rear leg members are curved.

7. A radio as defined in claim 6, wherein the antenna nut is reflow soldered onto the printed circuit board.

8. A radio as defined in claim 6, wherein the radio housing includes an aperture and the threaded aperture located on the antenna nut is in registration to said radio housing aperture.

9. A radio as defined in claim 6, wherein the antenna nut has a back wall surrounding the threaded aperture and the radio housing mechanically biases the antenna nut at the back wall.

10. A antenna mounting assembly, comprising:

a printed circuit board having first and second opposed surfaces and first and second apertures located through the first and second opposed surfaces; and a surface mountable antenna nut attached to the printed circuit board, the surface mountable antenna nut, including:

a main wall member having a back wall;

a flanged section having a threaded aperture located on the main wall member for attaching to an antenna;

a front leg and a rear leg extending from the main wall member, the front leg received by the first aperture on the printed circuit board and the rear leg received by the second aperture; and the first aperture is plated allowing for the front leg to be soldered to the first aperture.

11. An antenna mounting assembly as defined in claim 10, wherein:

the printed circuit board includes a solder pad between the first and second apertures; and the main wall member of the surface mountable antenna nut includes an edge side which lies against the solder pad and is soldered to the solder pad.

12. An antenna mounting assembly as defined in claim 11, wherein the surface mountable antenna nut is reflow soldered to the printed circuit board.

13. An antenna mounting assembly as defined in claim 10, wherein the rear leg is curved and is required to be inserted before the front leg of the antenna nut, the curved rear leg providing support to the antenna nut when it is surface mounted to the printed circuit board.

* * * * *